United States Patent [19]

Martensson et al.

[11] Patent Number: 4,989,012

[45] Date of Patent: Jan. 29, 1991

[54] ANTENNA ASSEMBLY

[75] Inventors: Nils E. W. Martensson, Woking; Michael B. Ashdown, High Wycombe, both of England

[73] Assignee: Technophone Limited, Surrey, England

[21] Appl. No.: 489,797

[22] Filed: Mar. 5, 1990

Related U.S. Application Data

[63] Continuation of Ser. No. 351,434, May 12, 1989, abandoned.

[30] Foreign Application Priority Data

May 27, 1988 [GB] United Kingdom ..... 8812703

[51] Int. Cl.[5] ..... H01Q 1/24

[52] U.S. Cl. ..... 343/702; 343/900; 343/876

[58] Field of Search ..... 343/702, 900, 901, 876, 343/889, 893, 906

[56] References Cited

U.S. PATENT DOCUMENTS

| | | | |
|---|---|---|---|
| 3,087,117 | 4/1963 | Mitchell | 343/702 |
| 3,154,785 | 10/1964 | Taylor | 343/702 |
| 3,946,390 | 3/1976 | Alexander et al. | 343/702 |
| 3,969,728 | 7/1976 | Hodsdon et al. | 343/702 |
| 4,286,335 | 8/1981 | Eichler et al. | 343/702 |
| 4,725,845 | 2/1988 | Phillips | 343/702 |

FOREIGN PATENT DOCUMENTS

| | | |
|---|---|---|
| 2323612 | of 0000 | Fed. Rep. of Germany . |
| 2311419 | of 0000 | France . |
| 2406317 | of 0000 | France . |
| 1366089 | of 0000 | United Kingdom . |

*Primary Examiner*—Rolf Hille
*Assistant Examiner*—Hoanganh Le
*Attorney, Agent, or Firm*—Perman & Green

[57] ABSTRACT

An adapter (13) for enabling an external antenna, e.g. an antenna fitted to a vehicle, to be connected in place of an existing antenna (7) on a radio, particularly a portable radio telephone (1). The adapter is slidably located in a passageway (6) which may be part of an integral moulding of a radio casing (2). The existing antenna (7) may be slidably located in the passageway such that it can be displaced and so disconnected from the radio when the adapter is fitted. Alteratively, the radio has an internal existing antenna which is switched out when the adapter makes an external antenna connection, e.g., by means of contacts (15,16) mounted in the adapter and in the passageway (FIGS. 3 and 4). The slidable antenna (7) may be in the form of a tape having a bowed cross-section.

22 Claims, 3 Drawing Sheets

ANTENNA ASSEMBLY

This is a continuation of Ser. No. 07/351,434 filed on 5/12/89, now abandoned.

BACKGROUND OF THE INVENTION

This invention relates to an antenna assembly which enables a radio to operate with either an existing antenna, or with an external antenna. The invention may be applied, for example, to a portable radio and, in particular, to a radio telephone.

A radio intended for two-way communication usually operates with either an external fixed rod or adjustable (e.g. telescopic) antenna, or with an internal antenna. In either case, such antennas will be included within the term 'existing antenna' as used herein.

Some known portable radio systems have two existing antennas, i.e. an internal element together with a retractable element, and are also equipped with means for automatically switching between the two elements according to the physical position of the retractable element. For example, the internal element may be some form of parallel plate antenna and the retractable element may be of the telescopic tube type. Such a system generally has the disadvantage that no immediate means is available to connect an external independent antenna in place of the self-contained system.

British patent GB-A-844,968 discloses an arrangement for connecting an external antenna to a radio receiver having a single existing, internal antenna intended for use in a vehicle. A housing is provided into which the radio is slidably mounted. A jack plug connected to the external antenna is fixedly mounted on the rear wall of the housing so that when the radio is fully inserted into the housing the jack plug mates with an antenna socket provided in the back of the radio apparatus. The housing acts to screen the internal antenna and thereby render it inoperative when the jack plug and hence the external antenna are connected. This arrangement requires the radio to be almost completely encased within the housing, so making the radio relatively inaccessible when connected to the external antenna. Also, since the internal antenna remains physically and electrically connected to the radio circuits, this arrangement is not suitable for a radio intended for transmission as well as reception.

SUMMARY OF THE INVENTION

The present invention seeks to provide a solution to the problem of facilitating the temporary connection to a two-way radio of an external antenna (such as an antenna fitted to a vehicle) in the place of an existing antenna.

The invention overcomes this problem by providing walls defining a passageway for slidably receiving an external antenna connecting device. The passageway is provided with contact means for making an antenna connection with contact means provided on the antenna connecting device so that when the body is slidably inserted into the passageway, the existing antenna is disconnected from the radio as or when the external antenna connecting device makes the antenna connection.

An advantage of the above arrangement is that it enables a rapid and simple external antenna coupling to be made to the radio. This is particularly useful when the user of a portable radio wishes to use an external antenna, fitted to a vehicle, on entering the vehicle and to rely on the existing antenna when leaving the vehicle. If required, an antenna matching network may be provided to match the external antenna to the radio circuit and advantageously this network can be housed in a body which is part of the antenna connecting device.

The contact means in the passageway preferably includes a coaxial connector, the contact means in the antenna connecting device being shaped to make contact therewith. This is unusual in that the coaxial connection is made by sliding the antenna connecting device transversely of the axis of the coaxial connector instead of moving it parallel to its axis as is normally the case. If required, spring contacts may also be provided for ancillary circuits.

According to one arrangement, applicable to a radio in which the antenna is slidably received in the passageway, the existing antenna is displaced and thereby disconnected from the radio when the external antenna connecting device is inserted into the passageway to make the (external) antenna connection.

According to another arrangement, applicable to a radio having an internal antenna, the internal antenna is disconnected by switching means actuated when the antenna connecting device is inserted into the passageway to make the (external) antenna connection. Such switching means may be part of the radio circuit, e.g. a semiconductor device which is turned on or off when spring contacts (forming part of the contact means) on the body of the external antenna connecting device are bridged by a conductive pad on the body.

In a preferred embodiment, the passageway is defined by walls which also define a slot through which part of the body of the antenna connecting device antenna extends. For example, the passageway and the body may be T-shaped, the limb of the T extending through the slot when the body is slidably received in the passageway.

Means, such as spring biased contacts, elements or detents, may be provided to positively locate the body of the antenna connecting device at the position at which the contact means make electrical connection. For example the central connector (pin) of a coaxial connector forming the contact means in a wall in the passageway may be biasingly mounted to engage with a recess or aperture (socket) of the central connector (socket) of a coaxial connector forming the mating contact means in the body (or vice versa). Alternatively, or in addition, a spring-loaded element which is not necessarily part of the contact means may assist in providing positive location to ensure that the antenna connecting device is located in the proper position for making the antenna connection.

Embodiments of the invention will now be described, by way of example, with reference to the accompanying drawing in which:

DESCRIPTION OF THE PREFERRED EMBODIMENTS

Whilst the preferred embodiments of the invention will be described with reference to a portable radio telephone, it will be understood that the invention can be applied more widely. For example, instead of being an integral part of, or an attachment to a radio casing, the invention may be embodied in an independent antenna assembly provided for fitment to a radio.

Figure 8:
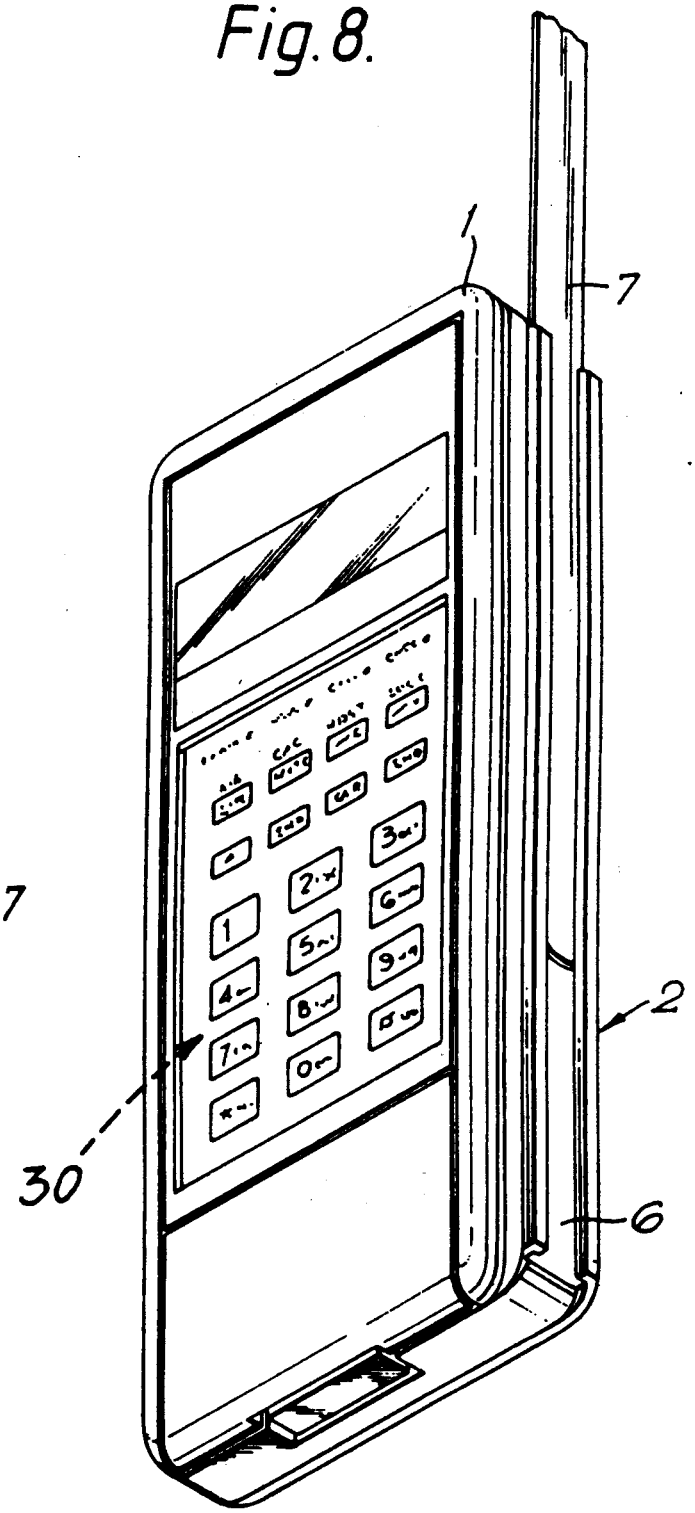
FIG. 8 is a perspective view of a portable radio telephone incorporating a tape antenna in accordance with FIG. 1.
Figure 7:
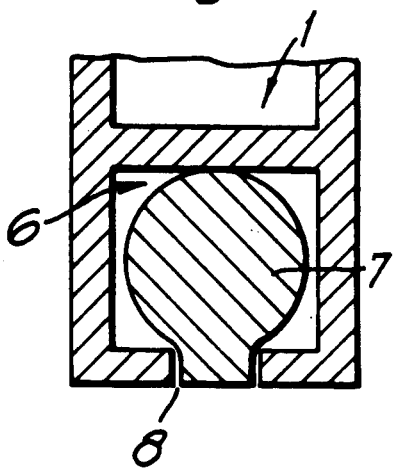
FIG. 7 is a cross-section of part of a radio casing similar in some respects to FIG. 1 and showing an antenna with a circular cross-section.
Figure 1:
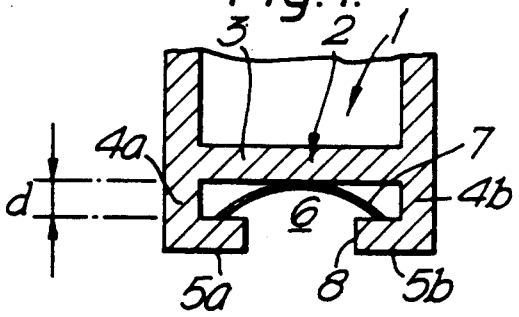
FIG. 1 is a cross-section of a part of a radio casing showing a tape antenna with a bowed cross-section.
Figure 9:
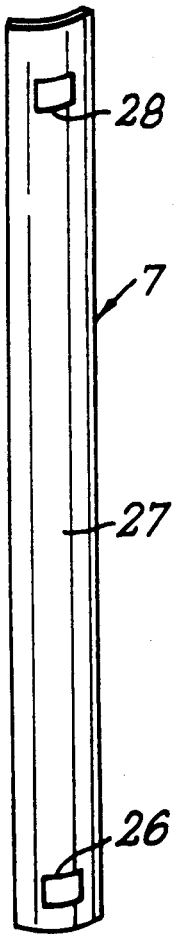
FIG. 9 is a plan view of an insulated tape antenna.

FIG. 1 shows a cross-section through part of a radio casing 1, containing conventional circuitry and components (not shown). Referring also to FIG. 8, a radio incorporating features of the present invention is shown with a casing 1 and having conventional circuitry and components 30 therein. Referring back to FIG. 1, the casing 1 includes an integral housing 2 having walls 3, 4*a*, 4*b*, 5*a*, 5*b* which define a T-shaped passageway 6 in which an antenna 7 is located. The antenna 7 is in the form of a tape having a bowed or arcuate cross-section. The tape 7 may be made from a thin sheet of spring metal which is electrically insulated by means of a layer or coating 27 of insulating material (see FIG. 9). However, some parts 26 and 28 of the tape are not insulated so that electrical connection can be made between the metallic sheet and electrical contacts.

The passageway 6 has a dimension 'd' which is slightly less than the natural radial extent of the bowed section of the tape 7, i.e. when the tape is not located in the passageway. The tape is then slightly distorted (compressed radially) when fitted into the passageway and this provides a degree of self-retention, e.g. for holding the tape in an extended position, or for preventing it from falling out of the passageway when retracted.

The bowed or arcuate cross-section of tape 7 provides a degree of inherent rigidity when the antenna is extended i.e. to prevent it from folding. This and various other configurations of tape antenna are disclosed and claimed in our co-pending application No. 351,866 filed May 12, 1989 entitled "Retractable Antenna" by the same inventors as herein and assigned to the same assignee as herein filed simultaneously herewith.

Figure 2:
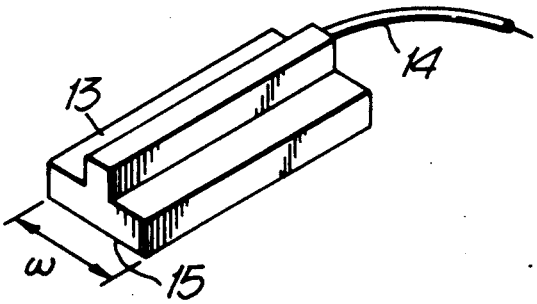
FIG. 2 is a perspective view of an adapter comprising a matching network housed in a body which is shaped to slide into the passageway of the arrangement shown in FIG. 1, for connecting an external antenna in place of an existing antenna on a radio.

As shown in FIG. 2, an adapter has a body 13 with a T-shaped cross-section, the upper limb of the T having a width "w" which is slightly less than the width of the passageway 6 to provide a sliding fit therein. The lower limb of the T projects through the open slot 8 of the passageway 6 when the adapter is fitted to the radio (such as the radio shown in FIG. 8). The passageway 6 is open at its lower and/or upper end to enable the body 13 of the adapter to be inserted, thereby displacing the antenna and, at the same time, disconnecting it from the radio circuit as explained below. In the preferred embodiment, a matching network 28 shown schematically in FIG. 11 and housed by body 13 is specifically intended to enable an external cable or antenna having a characteristic impedance of 50 ohms to be matched to the circuitry of the radio. The body 13 also provides anchorage for the coaxial cable 14 which is connected to the external antenna or to a coaxial connector.

Figure 3:
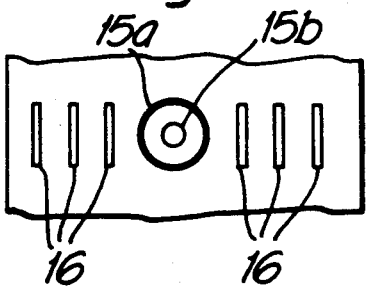
FIG. 3 illustrates a portion of an inner wall of the passageway showing a series of contacts and a connector for making electrical contact with a sliding antenna or the adapter shown in FIG. 2.
Figure 4:
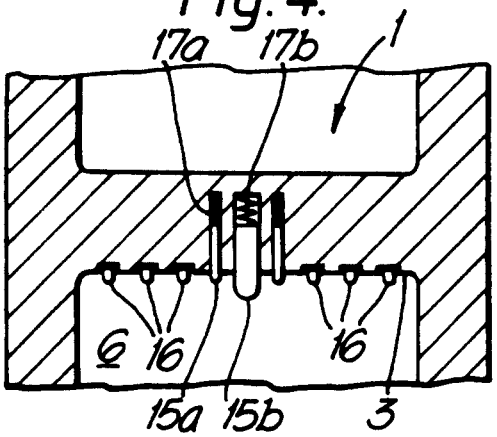
FIG. 4 is a section through part of a radio casing having the contact arrangement shown in FIG. 3 for mating with the adapter of FIG. 2.
Figure 5:
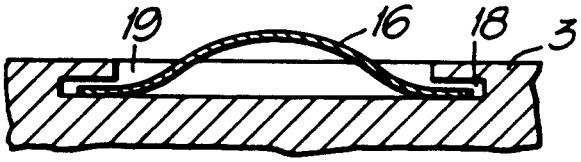
FIG. 5 shows a side elevation of a spring contact used in the arrangement of FIG. 4.
Figure 6:
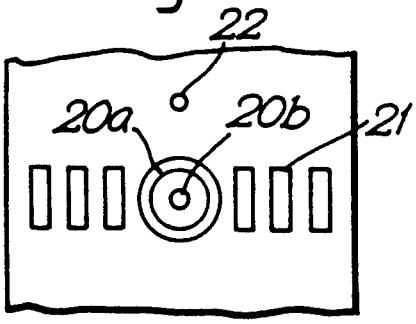
FIG. 6 shows the contact arrangement on the base of the adapter shown in FIG. 2.

As shown in FIGS. 3–5, a coaxial connector 15*a*, 15*b* and a series of spring contacts 16 are set into the rear wall 3 of the passageway 6. The coaxial connector is connected to the antenna circuit of the portable radio and the spring contacts are connected to supplementary circuits (the connecting leads are not shown in the drawing in order to simplify the illustration). The coaxial connector comprises a ground ring 15*a* and a central RF signal connection pin 15*b*, both of which are biasingly urged outwardly of the plane of the drawing by respective springs 17*a*, 17*b*. The spring contacts 16 are bowed in shape and the ends of the bow are inserted into recesses 18 in the ends of a groove 19 in the rear wall 3 of the passageway 6. Connectors 15*a*, 15*b* and the spring contacts 16 mate with a corresponding coaxial connector and contact arrangement provided on, or in, the lower wall 15 of the body 13, as shown in FIG. 6. This arrangement includes annular and circular pads 20*a*, 20*b* for engaging ground ring 15*a* and pin 15*b*, and rectangular pads 21 for engaging spring contacts 16. If necessary, a further conventional spring-loaded element or detent (mentioned again in more detail below) may be provided to ensure that the body 13 of the adapter is positively and correctly located in the passageway 6 in order to make an antenna (and other) connection.

The arrangement described with reference to FIGS. 2 and 3 need not necessarily be used with an antenna in the form of a tape. For example, FIG. 6 is a cross section of part of a radio casing showing an antenna with a circular cross-section. In this embodiment, the body 13 of the adapter may have a square cross section to provide a sliding fit within the passageway 6. Otherwise, the construction and operation of the adapter is the same.

In operation, the existing (sliding) antenna 7 on the radio casing makes electrical contact with the central pin 15*b* of a coaxial connector shown in FIG. 3. This is achieved by providing a window 26 in a layer of insulation 27 deposited on the outer surface of conductive antenna 7 (see FIG. 9) as described in more detail in our aforementioned co-pending application. This window provides access for pin 15*b* when the antenna 7 is extended to its operating location but prevents the biased ground ring 15*a* from making electrical contact with antenna 7, because the window is only sufficiently large to freely accommodate pin 15*b*. (There is no need for the antenna 7 to make electrical contact with the ground ring 15*a* since sufficient coupling is provided by the signal pin 15*b*.)

When the user wishes to employ the external antenna connected to the coaxial cable 14 of the adapter, he inserts the body 13 of the adapter into the passageway 6 thereby displacing the antenna 7 and disconnecting it from the radio. The adapter is then slid along the passageway until its contacts mate with the coaxial connectors 15a, 15b and contacts 16 in the wall of the passageway 6. The user may "feel" such location between the coaxial connectors and/or detent, but a stop may also be used to prevent the adapter from being inserted too far into the passageway 6.

Whilst the coaxial cable 14 is normally anchored to the adapter body 13, the adapter body may be modified by having a coaxial connector instead of the cable as shown in FIG. 2. This would be useful, for example, in a factory or service department test system.

Figure 10:
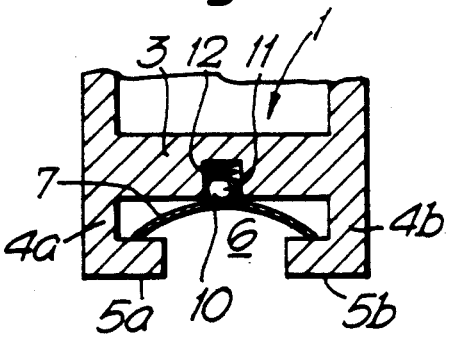
FIG. 10 is similar to FIG. 1, but additionally shows a spring loaded detent for positively locating the tape in a give position.

When it is required to provide a more positive location for the adapter body 13, i.e. at the antenna connection point, a spring-loaded ball 11, 12 may be provided in the rear wall 3 of the passageway above and/or below the contact arrangement as shown in FIG. 10. In this case, the under surface of the adapter body 13, i.e. the surface which confronts wall 3, has a hole or recess 22 for the or each spring-loaded ball, each hole or recess 22 being located above and/or below the contact arrangement shown in FIG. 6. The spring-loaded ball arrangement may also be modified to provide the central connection of a coaxial connector for the adapter shown in FIGS. 3 and 4, the central pin 15b being replaced by the ball, and a biased or some other ground ring being additionally provided.

Figure 11:
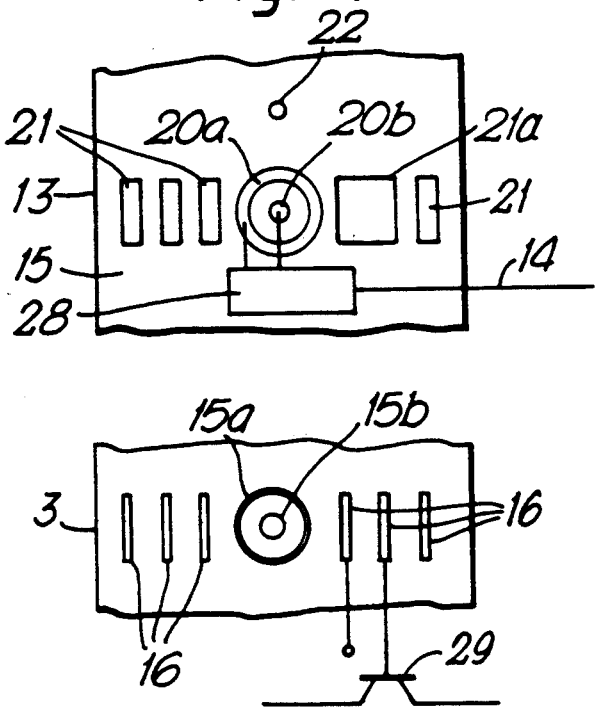
FIG. 11 is similar to FIG. 2 together with FIG. 6, but additionally shows the external antenna matching network and the existing antenna switching means.

If it is desired to use the adapter with a radio having an internal antenna (i.e. instead of a telescopic antenna), then insertion of the adapter causes a switching device (e.g. a transistor 29 in the radio circuit) to change state, so as to disconnect the internal antenna from the radio, see FIG. 11. The switching device is actuated, for example, by a broad pad 21a on the lower wall 15 of the body 13. The pad 21a is the width of two adjacent contacts 21 and which bridges a pair of spring contacts 16 in the rear wall 3 of the passageway 6, the spring contacts being connected to part of the radio circuit for actuating the switching device 29.

In view of the foregoing, it will be evident to a person in the art that various modifications may be made within the scope of the present invention defined in the following claims. For example, the connector 15a in the rear wall 3 of the passageway 6 need not be in the form of a continuous ring, but may instead be in the form of separate arcs of a circle. Alternatively, the connector 15a need not even be in the form of a ring. For example, it may be formed by one or more discrete pin-like contacts, the individual pin(s) being located on the circumference of a circle corresponding to the connector 20a on the adapter 13 in order to make electrical contact therewith.

We claim:

1. A radio and antenna assembly comprising a radio casing having walls which define a passageway, an existing antenna connected to said casing, and a connecting device for connecting an external antenna to a circuit inside said radio casing, said connecting device being suitably sized and shaped to be slidably receivable in said passageway and having first electrical contact means, said passageway being provided with a second electrical contact means generally transverse to the path of said passageway for mating with said first contact means to make an external antenna connection when said connecting device is slidably inserted into said passageway, said existing antenna being electrically disconnected from the circuit inside said radio casing as a result of sliding said connecting device into said passageway in order to make said external antenna connection whereby said connecting device can be removably attached to said radio casing for connecting an external antenna to a circuit inside said radio casing.

2. An assembly as claimed in claim 1, wherein said second contact means comprise a coaxial ground contact and an RF signal pin which are biasingly mounted to engage with a ground contact and a signal contact mounted on said device.

3. An assembly as claimed in claim 2, wherein said existing antenna is slidably mounted in said passageway so that said existing antenna is displaced and thereby disconnected from a circuit inside said radio casing when said antenna connecting device is inserted into said passageway in order to make said external antenna connection.

4. An assembly as claimed in claim 3, wherein said existing antenna has insulation thereon which isolates said existing antenna from a ground part of said second contact means but permits electrical contact to be made with an RF signal part of said second contact means when said existing antenna is in a predetermined extended position.

5. An assembly as claimed in claim 4, including means for engaging said existing antenna at a predetermined position when extended from said passageway.

6. An assembly as claimed in claim 2, and further comprising switching means actuated in response to slidably inserting said external antenna connecting device into said passageway so as to make said external antenna connection and to electrically disconnect said existing antenna from a circuit inside said radio casing.

7. An assembly as claimed in claim 6, wherein said second contact means further includes biased contacts connected to auxiliary circuits in said radio casing and said first contact means further includes contacts for mating with said biased contacts.

8. An assembly as claimed in claim 7, wherein said device is T-shaped and said passageway is defined by said walls which define an open slot for receiving the lower limb of said T-shaped device.

9. An assembly as claimed in claim 8, wherein said existing antenna is in the form of a tape, said tape and said passageway being cooperatingly shaped such that said tape has a transverse bend in said passageway so as to impart rigidity to said tape when extended from said passageway.

10. An assembly as claimed in claim 9, wherein the antenna connecting device houses a matching network for matching an external antenna to a circuit inside of said radio casing.

11. An assembly as claimed in claim 6, including means for engaging said existing antenna at a predetermined position when extended from said passageway.

12. An assembly as claimed in claim 11, wherein said second contact means further includes biased contacts connected to auxiliary circuits in said radio casing and said first contact means further includes contacts for mating with said biased contacts.

13. An assembly as claimed in claim 1, wherein said existing antenna is slidably received in said passageway so that said existing antenna is displaced and thereby disconnected from a circuit inside said radio casing when said antenna connecting device is inserted into said passageway in order to make said external antenna connection transverse to said passageway.

14. An assembly as claimed in claim 13, wherein said existing antenna has insulation thereon which isolates said existing antenna from a ground part of said second contact means but permits electrical contact to be made with an RF signal part of second contact means when said existing antenna is in a predetermined extended position.

15. An assembly as claimed in claim 13, including means for engaging said existing antenna at a predetermined position when extended from said passageway.

16. An assembly as claimed in claim 1, further comprising switching means actuated in response to slidably inserting said external antenna connecting device into said passageway so as to make said external antenna connection and to disconnect said existing antenna from a circuit inside said radio casing.

17. An assembly as claimed in claim 1, wherein said second contact means further includes biased contacts connected to auxiliary circuits in said radio casing and said first contact means further includes contacts for mating with said biased contacts.

18. An assembly as claimed in claim 1, wherein said device is T-shaped and said passageway is defined by said walls which define an open slot for receiving the lower limb of said T-shaped device.

19. An assembly as claimed in claim 18, wherein said existing antenna is in the form of a tape, said tape and said passageway being cooperatingly shaped such that said tape has a transverse bend in said passageway so as to impart rigidity to said tape when extended from said passageway.

20. An assembly as claimed in claim 1, wherein said antenna connecting device houses a matching network for matching an external antenna to a circuit inside of said radio casing.

21. A radio having radio circuitry and an existing antenna electrically connected to the radio circuitry, said radio comprising:

a housing substantially enclosing the radio circuitry and at least a portion of the existing antenna, said housing having an external antenna connecting channel for removably receiving a connector to an external antenna, said channel being suitably sized and shaped to slidably receive and retain the external antenna connector therein;

means for electrically connecting the external antenna to the radio circuitry upon insertion of the external antenna connector into said channel; and means for electrically disconnecting the existing antenna from the radio circuitry upon insertion of the external antenna connector into said channel.

22. A radio as in claim 21 wherein said means for electrically connecting comprises a radio circuitry electrical contact extending transversely into said channel for connecting the external antenna connector to the radio circuitry.

* * * * *